United States Patent [19]

Schmidt

[11] 4,106,214

[45] Aug. 15, 1978

[54] DRYER ATTACHMENT

[76] Inventor: Robert H. Schmidt, 6223 E. 56th St., Indianapolis, Ind. 46226

[21] Appl. No.: 706,681

[22] Filed: Jul. 19, 1976

Related U.S. Application Data

[63] Continuation-in-part of Ser. No. 593,759, Jul. 7, 1975, abandoned.

[51] Int. Cl.[2] ..... F26B 19/00

[52] U.S. Cl. ..... 34/86; 34/133; 110/204; 165/128; 110/216

[58] Field of Search ..... 237/55; 432/223, 255, 432/179, 72; 34/86, 133, 139, 79, 85, 138, 219, 225, 235; 110/49 R; 165/128, 139

[56] References Cited

U.S. PATENT DOCUMENTS

| | | | |
|---|---|---|---|
| 1,014,573 | 1/1912 | Davis | 110/49 R |
| 1,131,944 | 3/1915 | O'Neil | 110/49 R |
| 2,224,760 | 12/1940 | Carter | 110/49 R |
| 3,157,391 | 11/1964 | Angelone | 34/133 |
| 3,232,591 | 2/1966 | Wiley, Jr. | 34/86 |
| 3,859,735 | 1/1975 | Katterjohn, Jr. | 34/86 |
| 3,959,892 | 6/1976 | Cloud et al. | 34/86 |
| 3,969,070 | 7/1976 | Thompson | 34/86 |

*Primary Examiner*—William F. O'Dea
*Assistant Examiner*—Henry C. Yuen
*Attorney, Agent, or Firm*—Robert A. Spray

[57] ABSTRACT

A heat reclaimer for use with a gas clothes dryer of the type including a rotary drum. The dryer includes a housing in the upper portion of which is a gas burner chamber. The heat generated in the gas burner is moved downwardly through the rotary drum by a blower mounted in the lower portion of the housing then out a discharge stack. The heat reclaimer includes a downwardly open conduit located centrally in the stack and recirculating a portion of the air from the stack back into the gas burner chamber, on the opposite side of the burner and on the downstream side of the heated air passage from the burner to the clothes dryer. An inverted deflector cone is mounted at the lower end of the conduit. The discharge stack has an enlarged diameter at the portion of the stack which contains the conduit. The junction of the conduit and the gas burner chamber is in the form of a long narrow slot to better mix the recirculating air with the air in the gas burner chamber. The normal make-up air openings into the housing and gas burner chamber are partially blocked off in favor of the heated air from the heat reclaimer by a plate.

9 Claims, 8 Drawing Figures

DRYER ATTACHMENT

CROSS REFERENCE TO RELATED APPLICATION

This is a continuation-in-part of applicant's application, Ser. No. 593,759, filed July 7, 1975 now abandoned.

BACKGROUND OF THE INVENTION

1. Field of the Invention

This invention relates to a heat reclaimer for a dryer.

2. Description of the Prior Art

It is desirable that a portion of the heated gases or air that is discharged from a gas clothes dryer be reused to obtain from it some of the heat that has been placed in it during the operation of the dryer. Such a procedure is used, for example, in the dryer arrangement of the U.S. Pat. No. 3,157,391 to Angelone. Some of the objects desired in such a device are reduced fuel expense, faster drying of a given size batch of clothes, cooler operation of the dryer, and a shorter period of time during which the heating apparatus of the dryer need operate.

SUMMARY OF THE INVENTION

This invention might include a heat reclaimer for use with a clothes dryer of the type including an upper heat generating chamber means, an intermediate chamber means including rotary drum dryer means, a lower outlet chamber means, and a blower for moving air through said outlet chamber means and discharge stack. The heat reclaimer includes a conduit positioned at and extending along a central section of said discharge stack and leading through the wall of the stack into the upper heat generating means. In one embodiment of the invention, the stack has an enlarged diameter at the conduit containing portion of the stack. There may also be provided a downwardly pointed conical deflector mounted on the lower end of the deflector.

Objects of this invention are to provide an improved heat reclaimer for use with a clothes dryer and to provide a heat reclaimer which causes the clothes dryer to operate more efficiently.

DESCRIPTION OF THE PREFERRED EMBODIMENT

Figure 1:
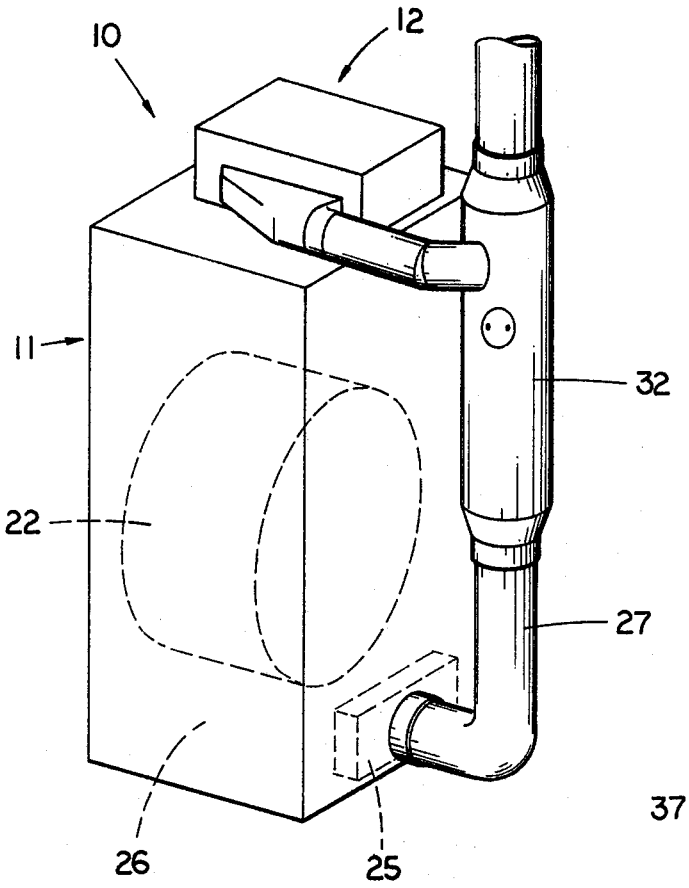
FIG. 1 is a perspective view of a dryer having the heat reclaimer of the present invention mounted thereon.
Figure 3:
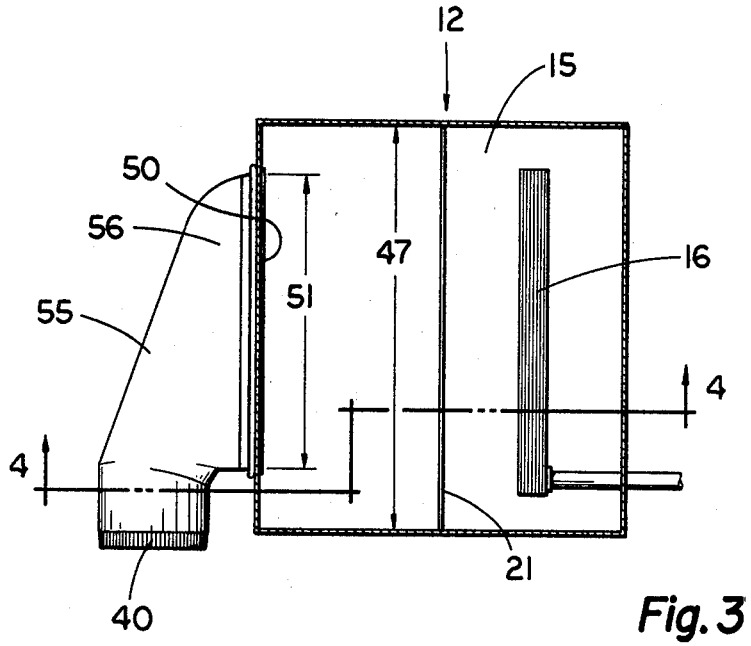
FIG. 3 is a horizontal section of a portion of the structure illustrated in FIG. 1.

Referring more particularly to FIG. 1, there is illustrated a dryer 10 which includes a housing 11. The housing 11 has an upper heat generating chamber apparatus 12 which includes a chamber 15 having mounted therein a gas burner 16 (FIG. 3). In operation the heated air in chamber 15 moves (FIG. 4) in the direction of the arrows 17 and 20 past a partition 21 down into the rotary drum portion 22 of the dryer.

A blower 25 is provided which sucks air from the heat generating apparatus 12 down through the rotary drum 22 thence through the lower outlet chamber 26, through the blower 25 and up and out the discharge stack 27. The dryer 10 might be any conventional commercially available dryer such as, for example, a Huebsch Routemaster commercial gas heated dryer manufactured by American Laundry Machinery Division Huebsch Originators of the McGraw-Edison Company, 5050 Section Avenue, Cincinnati, Ohio 45212.

Figure 2:
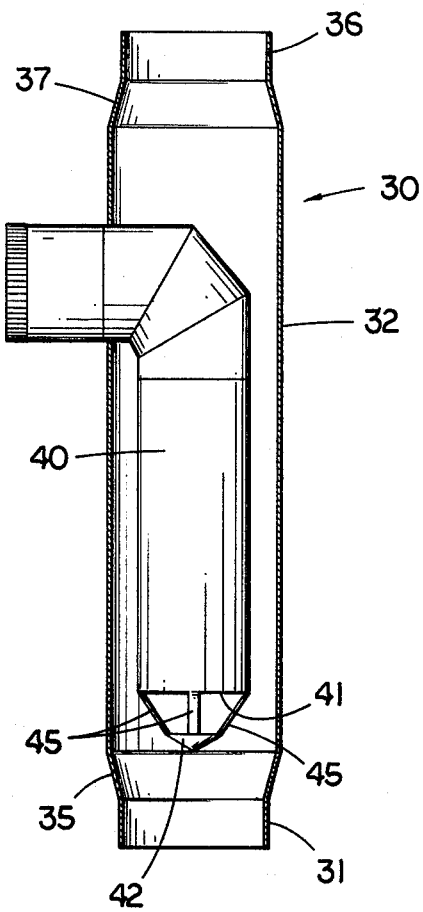
FIG. 2 is an enlarged vertical section of a portion of the structure illustrated in FIG. 1.

The heat reclaimer of the present invention is shown in part in FIG. 2 as including an insert 30 for mounting in the discharge stack 27. The insert 30 includes conduit material which is constructed to include a reduced diameter portion 31 which is connected to an enlarged diameter portion 32 by a tapering portion 35. The conduit material again is returned to the reduced diameter size at 36 by means of the tapering portion 37. In one specific embodiment of the invention the diameter of the reduced diameter portions 31 and 36 was 8 inches and the diameter of the enlarged diameter 32 was 9 inches.

Mounted within the enlarged diameter portion 32 is a conduit 40, the open end 41 of which faces downwardly. A deflector cone 42 is mounted by means of the rigid straps 45 to the lower end of the conduit 40. The deflector cone 42 has a smaller base diameter or base size than the size of the opening 41 in the conduit 40. In said one specific embodiment of the invention, the cone 42 had a base diameter of 3 inches and a height of one inch while the diameter of the conduit 40 was 6 inches.

The conduit 40 leads from the central portion of the discharge stack 27 and the insert 30 to the heat generating apparatus 12. It will be noted that the chamber 15 has a relatively broad passageway therethrough leading in the direction of the arrows 17 and 20. Thus the chamber 15 has a breadth dimension of 47 which in said one specific embodiment of the invention is 24 inches. The junction or coupling of the conduit 40 to the chamber 15 is accomplished by means of a long and narrow slot 50 which has its length dimension 51 extending in the direction of the breadth 47 of the chamber 15 and which has its height dimension 52 extending vertically. In said one specific embodiment of the invention, the dimension 51 is 14 inches, and the dimension 52 is approximately 2 inches.

Figure 4:
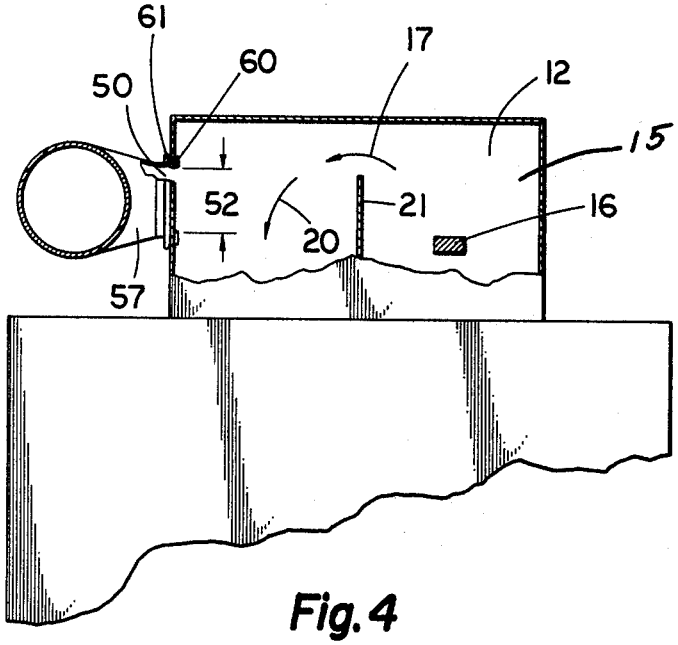
FIG. 4 is a vertical section taken along the lines 4—4 of FIG. 3 in the direction of the arrows.
Figure 5:
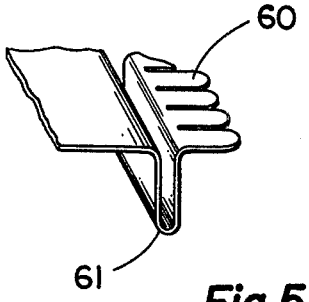
FIG. 5 is an enlarged fragmentary perspective view of a portion of the structure illustrated in FIG. 4 but showing it in greater detail.

FIGS. 4 and 5 show the manner of mounting the conduit 40 to the heat generating apparatus 12. It will be noted that the coupling member 55 has been flattened at 56 so that its passageway 57 is flattened to gradually lead into and conform to the configuration of the slot 50 without abrupt changes in direction and the like. The coupling member 55 has a plurality of bendable fingers 60 which extend from a shoulder 61 so as to make the mounting of the coupling member 55 upon the heat generating apparatus 12 a quick and easily accomplished task. After the coupling member has been forced against the heat generating apparatus 12 so that the shoulder 61 engages apparatus 12 and the fingers 60 project into the chamber 15, the fingers are bent outwardly to secure the coupling member 55 in place.

In tests run on the heat reclaimer of this invention it has been found that a dryer equipped with the heat reclaimer obtained the same effectiveness in drying the same size batch of clothes and in removing the same amount of water out of the clothes as compared to no heat reclaimer but that the drying was accomplished with fifteen to twenty percent less gas used. This result was accomplished with fifteen to twenty percent less gas used. This result was accomplished because the dryer was able to keep the temperature of the drying air within the proper range without burning the gas for as long a period of time. It has also been found that the herein disclosed particular design of the heat reclaimer causes the wetter air in the discharge stack and also the major portion of the lint in the discharge stack to move on out of the discharge stack instead of being recycled while the dryer air moves into the conduit 40. It has also been found that the heat reclaimer of the present invention permits the dryers upon which it is mounted to operate within their normal operating range yet improves the efficiency of the dryers. For example, the heat reclaimer does not produce "hot spots" inside the chamber 15 or scorching of the clothes; the heat reclaimer does not increase the output pressure in the discharge stack which can cause untimely operation of safety switches, "lazy" flame and even fires; and the heat reclaimer does not make necessary a modification or change in the normal gas/air mixtures in the heat generating apparatus 12.

In the above description of FIGS. 1–5, the make-up air or secondary burner air is reduced by mounting the coupling member 55 on the slot 50. Prior to the installation of the heat reclaimer of the present invention, the slot 50 in the original equipment dryer is open to atmosphere permitting outside air to be sucked into the chamber 15 and to move downwardly along with the heated air in the direction of the arrows 17. However, this air which normally moves into the chamber 15 through the slot 50 is replaced by the heated air-gas mixture moving through the conduit 40 into the coupling member 55. For this reason, as mentioned above, the heat reclaimer does not make necessary a modification or change in the normal gas/air mixtures in the heat generating apparatus 12.

Generally speaking, the heat reclaimer of this invention may be used with various types of dryers manufactured by various concerns, for example, dryers known as electric or steam dryers and gas dryers other than the above-mentioned Huebsch gas dryer. For example, the heat reclaimer may be used with a Cissell model L28BD 30 manufactured by W. M. Cissell Manufacturing Company of Louisville, Ky. When the heat reclaimer is used with the Cissell unit, the outside air supply opening which measures approximately 4 × 24 is only partially blocked off. That is approximately 40 percent of the opening is blocked off and the coupling member 55 is mounted into a specially cut opening separate from the outside air opening and not present in the dryer as original equipment. As a general rule for gas dryers, it has been found that by blocking off approximately 40 percent of the original equipment outside air supply openings, the dryer is capable of operating without changing the normal gas/air mixtures and without causing dryer problems such as lazy flame, temperature too hot in tumbler, clothes taking too long to dry, etc.

Figure 6:
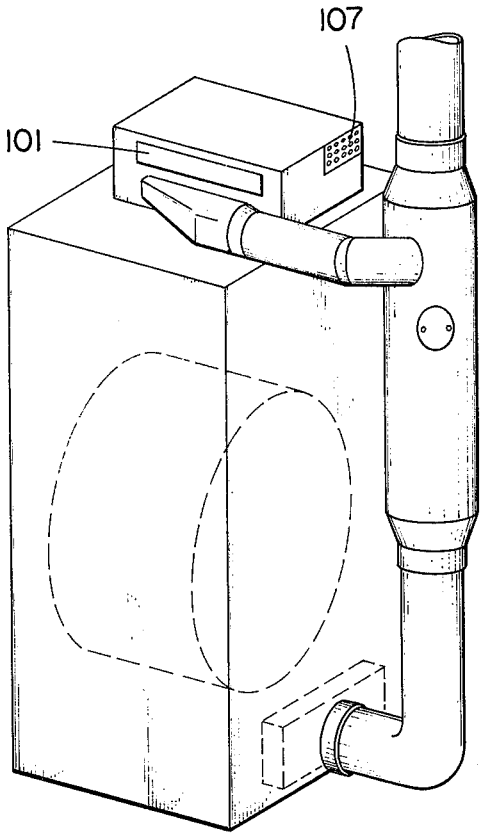
FIG. 6 is a view similar to FIG. 1 of a dryer which is an alternative embodiment of the invention and showing certain features in greater detail as compared to FIG. 1.
Figure 7:
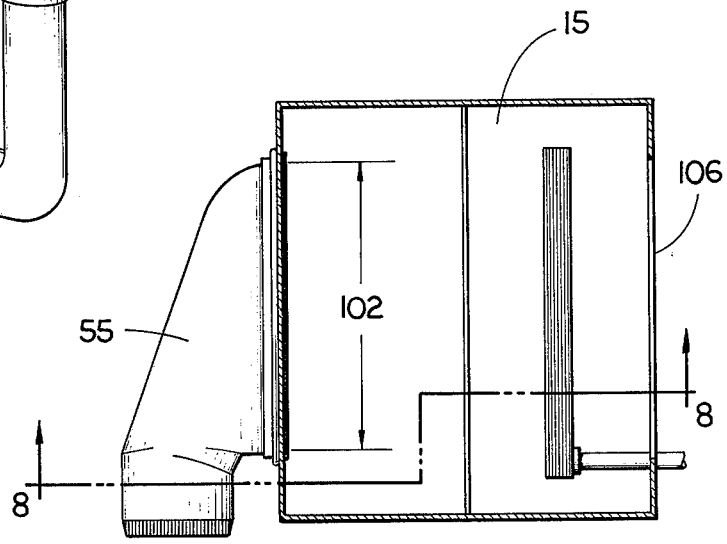
FIG. 7 is a horizontal sectional view similar to FIG. 3 of the structure of FIG. 6 taken along the line 7—7 of FIG. 8.
Figure 8:
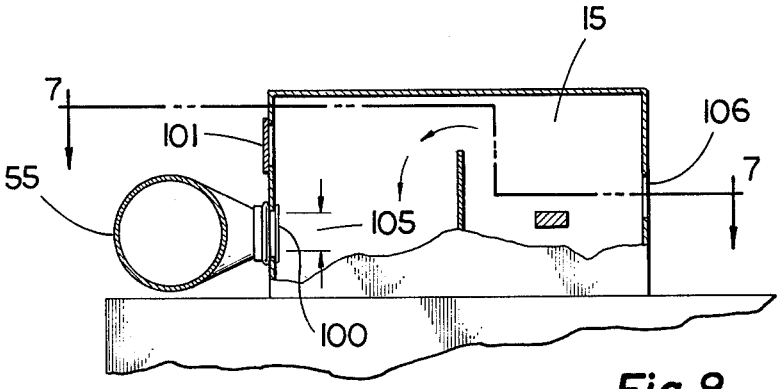
FIG. 8 is a vertical sectional view similar to FIG. 4 of the structure of FIG. 6 taken along the line 8—8 of FIG. 7.

Referring now to FIGS. 6, 7 and 8, a Huebsch 30 BG model manufactured by Huebsch Originators of Milwaukee, Wisconsin, is shown in greater detail than the showing of FIGS. 1–5. Generally, the disclosure of FIGS. 6–8 is identical to that of FIGS. 1–5, except as described below. Instead of using the original equipment opening 50 as a location for mounting the coupling member 55, the coupling member 55 is provided with a specially cut opening 100 located three or four inches below the existing opening 50. The opening 50 is then blocked over by a plate 101 which may be secured in place by any suitable means so long as it closes off the opening 50. As indicated above, the size of the opening 100 is 2 inches by 14 inches. That is, the dimension 102 is 14 inches and the dimension 105 is 2 inches. The standard length of the opening slot 50 in the Huebsch 30 BG is slightly shorter than the 14 inch dimension 102. The advantage of mounting the coupling 55 as shown in FIGS. 6, 7 and 8 is that the incoming heated air/gas mixture from the conduit 40 does not cause turbulence and interfere with the burner 16. It has been found that the 15 to 20 percent saving in gas mentioned above on page 6 is thereby increased to approximately a 30-35 percent savings in gas.

Closing off of the opening 50 by the plate 101 has the effect of closing off approximately 40 percent of openings for make-up air or secondary air. This is true because there are two other make-up air openings 106 and 107 in the Heubsch 30 BG model which lead into the chamber 15. When the heat reclaimer is so installed in the Huebsch 30 BG model, there is no necessity to change or modify the normal gas/primary air mixtures and the dryer operates with equal effectiveness as without the heat reclaimer except that substantially less gas is needed for the same time period of operation with the same effectiveness of operation.

Certain other dimensions and proportions have been found to give the best operation. It has been found that the diameter of the base of the cone 42 should be preferably one half of the diameter of the conduit 40. When the base diameter was enlarged from three inches to six inches with the other proportions as shown in FIG. 2, the gas saving dropped from approximately 32 percent to approximately 18 percent. When the size of the base was reduced to one quarter the size of the conduit 40 diameter the gas saving dropped also to approximately 24 percent. Also, it is desirable that the opening between the cone 42 and the conduit 40 be equal in area to the internal cross-sectional area of the conduit 40 in order to obtain the greatest savings in gas.

It has also been found that the proportional relationship of 9, 8 and 6 of the diameter of portion 32, portion 31 and conduit 40 is important. This has been established by comparative tests in which the gas savings was compared while other parameters were held equal. The chart below indicates the results obtained.

| Portion 32 | Portion 31 | Conduit 40 | Gas Saving |
|---|---|---|---|
| 9" | 8" | 6" | 32% |
| 10" | 8" | 6" | 20% |
| 9" | 8" | 7" | 28% |
| 9" | 8" | 5" | 22% |

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. For example, the gas burner 16 may be located in a portion of dryer housing 11 other than the upper portion with the heated air conducted to the upper portion of the housing.

The invention claimed is:

1. A heat reclaimer for use with a clothes dryer of the type including a heat chamber means, an intermediate chamber means including rotary drum dryer means, an outlet chamber means, a discharge stack leading upwardly away from said outlet chamber means, and a blower for moving air through said outlet chamber means and discharge stack, said heat reclaimer comprising a conduit positioned at and extending along a central section of said discharge stack and leading through the wall of said stack and adapted to be coupled into said upper heat chamber means, said stack having an enlarged diameter at the conduit-containing portion of said stack;

in a combination in which the heat reclaimer conduit has at its upstream end a downwardly pointing conical deflector, which directs the air to the outer wall so that lint and moisture carried in the discharge stack air upstream will bypass the said reclaimer conduit rather than re-cycle back through the reclaimer;

and in which the heat reclaimer conduit has its downwardly pointing conical deflector located in the region of the discharge stack in which the diameter thereof increases to its said enlarged diameter.

2. The apparatus of claim 1 wherein said clothes dryer includes openings for supplying make-up air, from the room exterior of of the clothes dryer, to said heat chamber means and said intermediate chamber means, and means for closing off a portion of said openings from one or more of said outside room air, and providing more air to said heat chamber means by recycling some of the air from the discharge stack.

3. The apparatus of claim 2 wherein said portion is approximately 40 percent.

4. A heat reclaimer for use with a clothes dryer of the type including a heat chamber means, an intermediate chamber means including rotary drum dryer means, an outlet chamber means, a discharge stack leading upwardly away from said outlet chamber means, and a blower for moving air through said outlet chamber means and discharge stack, said heat reclaimer comprising a conduit positioned at and extending along a central section of said discharge stack and leading through the wall of said stack and adapted to be coupled into said heat chamber means, a downwardly pointing conical deflector mounted on said conduit at the lower end thereof, said conduit and deflector having passages therebetween whereby a portion of the air moving in said discharge stack moves through said passages into said conduit and into said heat chamber means;

and wherein said stack has an enlarged diameter at the conduit-containing portion of said stack;

and wherein the maximum diameter of said deflector at the base of its conical shape is less than the diameter of said conduit, said conduit having an open lower end which is partially covered by said deflector;

and wherein said upper heat chamber means includes a broad passageway for heated air which leads into the rotary drum dryer means, said conduit being flattened at the portion thereof that is connected to said upper heat chamber means and flattened to define an internal passageway in the conduit which is long and narrow in cross section so as to provide a long and narrow slot at the junction of the conduit and the upper heat chamber means, so as to thereby provide a substantial spread of said heat reclaimer's heated air across the breadth of the air stream moving into the rotary drum dryer means, said conduit being connected to said upper chamber means with the length of said slot across the breadth of said broad passageway.

5. The invention as set forth in claim 4 in a combination in which the flattened conduit portion, which is connected to the upper heat chamber means, is of a cross-sectional area at least about that of the cross-sectional area of the heat reclaimer conduit which leads through the wall of the said discharge stack.

6. A heat reclaimer for use with a clothes dryer of the type including a heat chamber means, an intermediate chamber means including rotary drum dryer means, an outlet chamber means, a discharge stack leading upwardly away from said outlet chamber means, and a blower for moving air through said outlet chamber means and discharge stack, said heat reclaimer comprising a conduit positioned at and extending along a central section of said discharge stack and leading through the wall of said stack and adapted to be coupled into said heat chamber means, a downwardly pointing conical deflector mounted on said conduit at the lower end thereof, said conduit and deflector having passages therebetween whereby a portion of the air moving in said discharge stack moves through said passages into said conduit and into said heat chamber means;

and in which said stack has an enlarged diameter at the conduit-containing portion of said stack;

the said deflector being located in the region of the discharge stack in which the diameter thereof increases to its said enlarged diameter and operative to direct the air to the outer wall so that lint and moisture carried in the discharge stack upstream thereof will bypass the said reclaimer conduit rather than re-cycle back through the reclaimer.

7. A heat reclaimer as defined in claim 6 wherein the maximum diameter of said deflector at the base of its conical shape is less than the diameter of said conduit, said conduit having an open lower end which is partially covered by said deflector.

8. The heat reclaimer of claim 7 wherein said maximum diameter of said deflector is approximately one half the diameter of said conduit.

9. The heat reclaimer of claim 8 wherein said conduit has a cross-sectional area approximately equal to the cross sectional area of the passages between said deflector and conduit.

* * * * *

UNITED STATES PATENT OFFICE

CERTIFICATE OF CORRECTION

Patent No. 4,106,214 Dated August 15, 1978

Inventor(s) Robert H. Schmidt

It is certified that error appears in the above-identified patent and that said Letters Patent are hereby corrected as shown below:

Col. 3, Lines 11 through 13: Cancel the entire sentence which reads as follows: "This result was accomplished with fifteen to twenty percent less gas used."

Col. 4, Lines appearing just above and below row-indicator No. 25: Delete the phrase "on page 6"

Col. 5, Line 38: Cancel the redundant second occurrence of the word "of"

Col. 5, Line 40: After "of" insert: -- one or more of --

Col. 5, Line 41: After "from" cancel the phrase "one or more of"

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*